US005685921A

United States Patent [19]

Dulmaine

[11] Patent Number: 5,685,921

[45] Date of Patent: Nov. 11, 1997

[54] METHOD OF PREPARING A MAGNETIC ARTICLE FROM A DUPLEX FERROMAGNETIC ALLOY

[75] Inventor: Bradford A. Dulmaine, Reading, Pa.

[73] Assignee: CRS Holdings, Inc., Wilmington, Del.

[21] Appl. No.: 594,936

[22] Filed: Jan. 31, 1996

[51] Int. Cl.[6] ..... H01F 1/00

[52] U.S. Cl. ..... 148/120; 148/121

[58] Field of Search ..... 148/120, 121

[56] References Cited

U.S. PATENT DOCUMENTS

| | | | |
|---|---|---|---|
| 3,783,041 | 1/1974 | Tokushima | 148/120 |
| 3,846,185 | 11/1974 | Nakajima et al. | 148/120 |
| 4,028,144 | 6/1977 | Tomishima et al. . | |
| 4,377,797 | 3/1983 | Jin et al. . | |
| 4,419,148 | 12/1983 | Jin . | |
| 4,536,229 | 8/1985 | Jin et al. . | |
| 4,812,176 | 3/1989 | Tanaka et al. . | |
| 5,505,797 | 4/1996 | Yokota et al. | 148/610 |

FOREIGN PATENT DOCUMENTS

| | | |
|---|---|---|
| 401114 | 4/1966 | Switzerland . |
| 1194568 | 12/1983 | United Kingdom . |

OTHER PUBLICATIONS

Patent Abstracts of Japan, vol. 005, No. 054 (Apr. 1981), JP 56005922 A (Mitsubishi Electric Corp.) Jan. 22, 1981.

Tiefel et al., "Microduplex Fe–Ni–Mo semihard magnet alloys", *J. Appl. Phys.*, vol. 55, No. 6, 15 Mar. 1984, pp. 2112–2114.

Jin et al., "High–Remanence Square–Loop Fe–Ni And Fe–Mn Magnetic Alloys", *IEE Transactions on Magnetics* vol. MAG–16, No. 5, Sep. 1980, pp. 1062–1064.

C. Heck, "Magnetic Materials and their Applications", pp. 277–9 (Crane, Russak, & Co., Inc., 1974).

*Primary Examiner*—John Sheehan

*Attorney, Agent, or Firm*—Dann, Dorfman, Herrell and Skillman, P.C.

[57] ABSTRACT

A process for preparing a duplex ferromagnetic alloy article is disclosed. The process includes the step of providing an elongated intermediate form of a ferromagnetic alloy having a substantially fully martensitic structure. The martensitic intermediate form undergoes an aging heat treatment under conditions of temperature and time that are selected to cause controlled precipitation of austenite in the martensitic alloy. The aged article is then cold-worked to a final cross-sectional dimension, preferably in a single reduction step, to provide an anisotropic structure and a coercivity, $H_c$, of at least 30 Oe.

13 Claims, 2 Drawing Sheets

METHOD OF PREPARING A MAGNETIC ARTICLE FROM A DUPLEX FERROMAGNETIC ALLOY

FIELD OF THE INVENTION

This invention relates to a process for preparing a magnetic article from a duplex ferromagnetic alloy and, in particular, to such a process that is simpler to perform than the known processes and provides a magnetic article having a desirable combination of magnetic properties.

BACKGROUND OF THE INVENTION

Semi-hard magnetic alloys are well-known in the art for providing a highly desirable combination of magnetic properties, namely, a good combination of coercivity ($H_c$) and magnetic remanence ($B_r$). One form of such an alloy is described in U.S. Pat. No. 4,536,229, issued to Jin et al. on Aug. 20, 1985. The semi-hard magnetic alloys described in that patent are cobalt-free alloys which contain Ni, Mo, and Fe. A preferred composition of the alloy disclosed in the patent contains 16–30% Ni and 3–10% Mo, with the remainder being Fe and the usual impurities.

The known methods for processing the semi-hard magnetic alloys include multiple heating and cold working steps to obtain the desired magnetic properties. More specifically, the known processes include two or more cycles of heating followed by cold working, or cold working followed by heating. Indeed, the latter process is described in the patent referenced in the preceding paragraph.

The ever-increasing demand for thin, elongated forms of the semi-hard magnetic alloys has created a need for a more efficient way to process those alloys into the desired product form, while still providing the highly desired combination of magnetic properties that is characteristic of those alloys. Accordingly, it would be highly desirable to have a method for processing the semi-hard magnetic alloys that is more streamlined than the known methods, yet which provides at least the same quality of magnetic properties for which the semi-hard magnetic alloys are known.

SUMMARY OF THE INVENTION

The disadvantages of the known methods for processing semi-hard magnetic alloys are overcome to a large degree by a method of preparing a duplex ferromagnetic alloy article in accordance with the present invention. The method of the present invention is restricted to the following essential steps. First, an elongated form of a ferromagnetic alloy having a substantially fully martensitic microstructure and a cross-sectional area is provided. The elongated form is then aged at a temperature and for a time selected to cause precipitation of austenite in the martensitic microstructure of the alloy. Upon completion of the aging step, the elongated form is cold worked in a single step along a magnetic axis thereof to provide an areal reduction in an amount sufficient to provide an $H_c$ of at least about 30 Oe, preferably at least about 40 Oe, along the aforesaid magnetic axis.

BRIEF DESCRIPTION OF THE DRAWINGS

Further objects and advantages of the present invention will become apparent from the following detailed description and the accompanying drawings in which.

DETAILED DESCRIPTION

Figure 1:
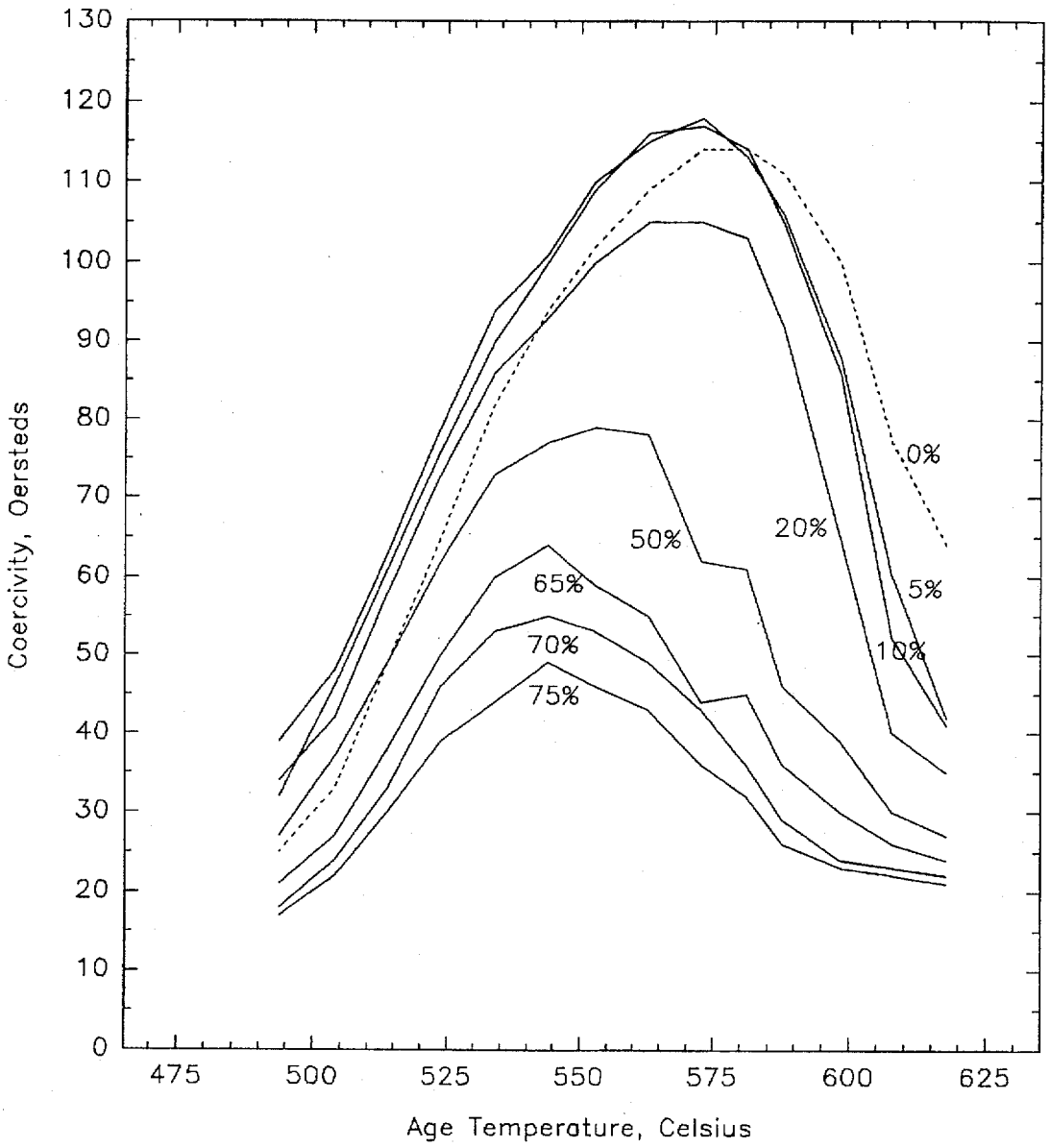
FIG. 1 shows a series of graphs of coercivity as a function of aging temperature and % cold reduction for specimens that were aged for four hours.

The process according to the present invention includes three essential steps. First, an elongated intermediate form of a ferromagnetic alloy having a substantially fully martensitic structure is prepared. Next, the martensitic intermediate form undergoes an aging heat treatment under conditions of temperature and time that are selected to cause controlled precipitation of austenite in the martensitic alloy. The aged article is then cold-worked to a final cross-sectional dimension, preferably in a single reduction step, to provide an anisotropic structure.

The elongated intermediate form, such as strip or wire, is formed of a ferromagnetic alloy that can be magnetically hardened. A magnetically hardened article is characterized by a relatively high coercivity. In general, a suitable ferromagnetic alloy is one that is characterized by a substantially fully martensitic structure that can be made to precipitate an austenitic phase by the aging heat treatment. A preferred composition contains about 16–30% Ni, about 3–10% Mo, and the balance iron and the usual impurities. Such an alloy is described in U.S. Pat. No. 4,536,229 which is incorporated herein by reference. The composition of the precipitated austenitic phase is such that it will at least partially resist transforming to martensite during cold deformation of the alloy subsequent to the aging treatment.

The elongated intermediate form of the ferromagnetic alloy is prepared by any convenient means. In one preferred embodiment, the ferromagnetic alloy is melted and cast into an ingot or cast in a continuous caster to provide an elongate form. After the molten metal solidifies it is hot-worked to a first intermediate size then cold-worked to a second intermediate size. Intermediate annealing steps may be carried out between successive reductions if desired. In another embodiment the ferromagnetic alloy is melted and then cast directly into the form of strip or wire. The intermediate elongated form can also be made using powder metallurgy techniques. Regardless of the method used to make the elongated intermediate form of the ferromagnetic alloy, the cross-sectional dimension of the intermediate form is selected such that the final cross-sectional size of the as-processed article can be obtained in a single cold reduction step.

The elongated intermediate form is aged at an elevated temperature for a time sufficient to permit precipitation of the austenitic phase. As the aging temperature is increased, the amount of precipitated austenite increases. However, at higher aging temperatures, the concentration of alloying elements in the austenitic phase declines and the precipitated austenite becomes more vulnerable to transformation to martensite during subsequent cold-working. The aging temperature that yields maximum coercivity depends on the aging time and declines as the aging time increases. Thus, the alloy can be aged at a relatively lower temperature by using a long age time, or the alloy can be aged at a relatively higher temperature by decreasing the age time. When using the preferred alloy composition, the intermediate form is aged at a temperature of about 475°–625° C., better yet, about 485°–620° C., and preferably about 530°–575° C.

The lower limit of the aging temperature range is restricted only with regard to the amount of time available. The rate at which austenite precipitates in the martensitic alloy declines as the aging temperature is reduced, such that if the aging temperature is too low, an impractical amount of time is required to precipitate an effective amount of austenite to obtain an $H_c$ of at least about 30 Oe. Aging times ranging from about 4 minutes up to about 20 hours have been used successfully with the preferred alloy composition. In particular, aging times of 1 hour and 4 hours have provided excellent results with that alloy.

The aging treatment can be accomplished by any suitable means including batch or continuous type furnaces. Alloys that have little resistance to oxidation are preferably aged in an inert gas atmosphere, a non-carburizing reducing atmosphere, or a vacuum. Relatively small articles can be aged in a sealable container. The articles should be clean and should not be exposed to any organic matter prior to or during aging because any carbon absorbed by the alloy will adversely affect the amount of austenite that is formed.

The third principal step in the process of this invention involves cold-working the aged alloy to reduce it to a desired cross-sectional size. The cold-working step is carried out along a selected magnetic axis of the alloy in order to provide an anisotropic structure and properties, particularly the magnetic properties coercivity and remanence. Cold working is carried out by any known technique including rolling, drawing, swaging, stretching, or bending. The minimum amount of cold work necessary to obtain desired properties is relatively small. A reduction in area as low as 5% has provided an acceptable level of coercivity with the preferred alloy composition.

Too much cold work results in excessive transformation of the austenite back to martensite in the alloy which adversely affects the coercivity of the final product. Therefore, the amount of cold work applied to the aged material is controlled so that the coercivity of the product is not less than about 30 Oe. Too much austenite present in the alloy adversely affects $B_r$. Thus, the amount of cold work applied to the aged alloy is further controlled to provide a desired $B_r$.

Based on a series of experiments, I have devised an approximate technique for determining the maximum percent cold reduction to provide the preferred coercivity of at least 40 Oe with the preferred Fe-Ni-Mo alloy. From data obtained in testing numerous specimens under a variety of combinations of aging temperatures and cold reductions, I have determined that the maximum amount of cold reduction that should be used to obtain an $H_c$ of at least 40 Oe, as a function of aging temperature, T, is substantially approximated by the following relationships.

(1) %Cold Reduction$\leqq$4.5T - 2205, for 490° C.<T$\leqq$510° C.;

(2) %Cold Reduction$\leqq$90, for 510° C.<T<540° C.; and (3) %Cold Reduction$\leqq$630 - T, for 540° C.$\leqq$T<630° C.

The foregoing relationships represent a reasonable mathematical approximation based on the test results that I have observed. For a given aging temperature and time, the amount of cold reduction for providing a coercivity of at least 40 Oe may differ somewhat from that established by Relationship (1), (2), or (3). However, I do not consider such differences to be beyond the scope of my invention. Moreover, other relationships can be developed for different levels of coercivity as well as different combinations of composition, aging time, and aging temperature in view of the present disclosure and the description of the working examples hereinbelow.

Through control of the aging time and temperature, and the amount of areal reduction, it is possible to achieve a variety of combinations of coercivity and remanence. I have found that as the percent of areal reduction increases, the aging conditions for obtaining a coercivity of at least 30 Oe shift to lower temperatures and longer times. For example, in the preferred alloy composition, an areal reduction of about 6% provides a coercivity of about 40 Oe and a remanence of about 12,000 gauss when the alloy is aged for 4 minutes at about 616° C. For the same alloy, an areal reduction of about 90% has provided a coercivity greater than 40 Oe and a remanence of about 13,000 gauss when the alloy is aged for 20 hours at about 520°–530° C.

Figure 2:
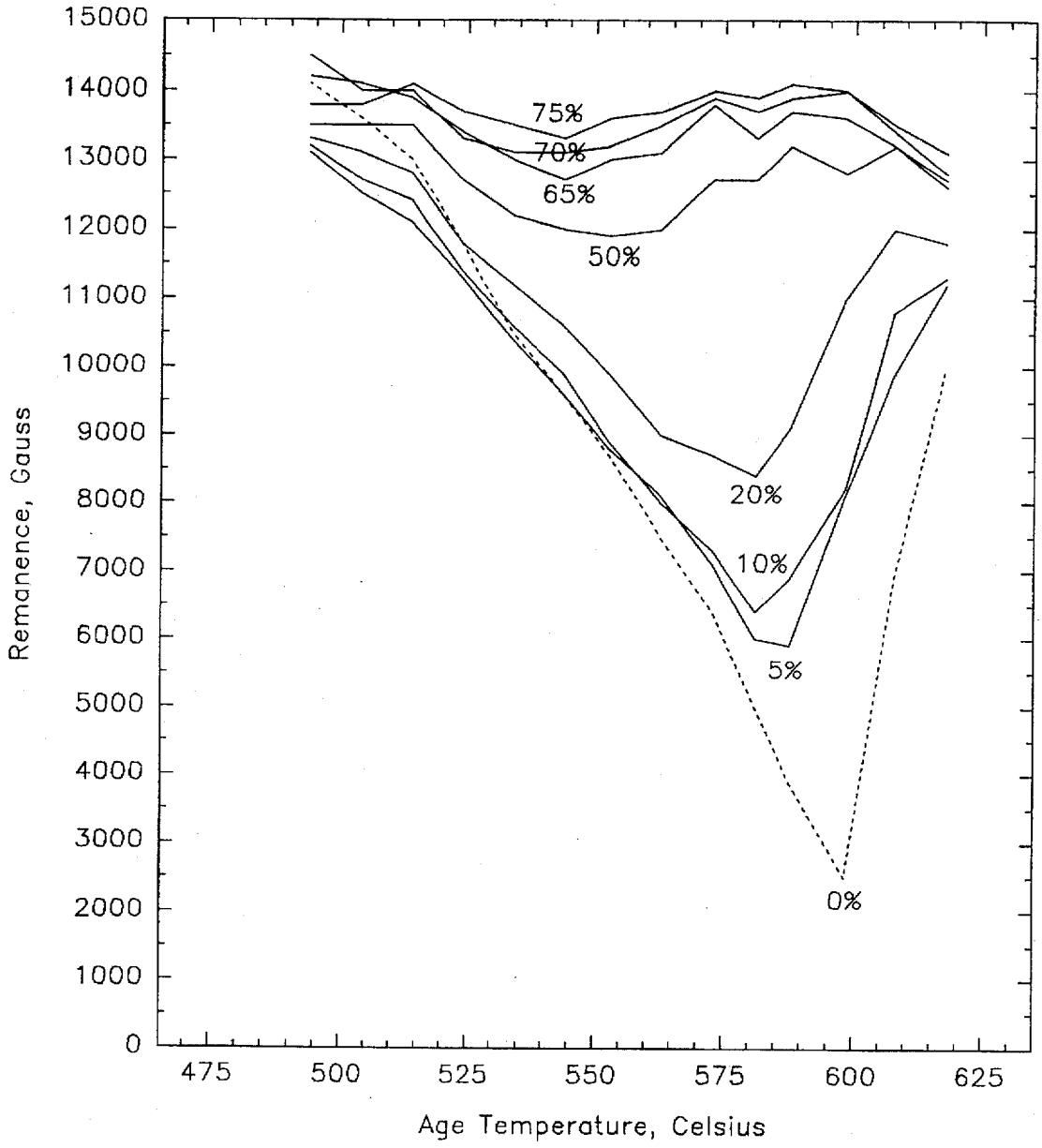
FIG. 2 shows a series of graphs of magnetic remanence as a function of aging temperature and % cold reduction for the same specimens graphed in FIG. 1.

FIG. 1 shows graphs of coercivity as a function of the amount of cold reduction and aging temperature for specimens aged for 4 hours. FIG. 2 shows a graph of remanence as a function of the amount of cold reduction and aging temperature for specimens aged for 4 hours. It can be seen from FIGS. 1 and 2 that for each level of cold reduction, the coercivity graph has a peak and the remanence graph has a valley. The aging temperatures that correspond to the peaks and valleys provide a convenient method for selecting an appropriate combination of aging temperature and time and the percent areal reduction for obtaining a desired $H_c$ or a desired $B_r$. To select the appropriate processing parameters, the preferred technique is to, first, select either $H_c$ or $B_r$ as the property to be controlled. If $H_c$ is selected, the amount of cold reduction that gives the target level of coercivity at its peak is found and the aging temperature that corresponds to that peak is used. On the other hand, if $B_r$ is selected, the amount of cold reduction that gives the target level of remanence at its valley is found, and the aging temperature that corresponds to that valley is used. The peak and valley data points as shown representatively in FIGS. 1 and 2 respectively, are important because they represent the points where the magnetic properties, coercivity and remanence, are least sensitive to variation in the aging temperature. Similar graphs can be readily obtained for other aging times as desired, depending on the particular requirements and available heat treating facilities.

EXAMPLES

To demonstrate the process according to the present invention a heat having the weight percent composition shown in Table I was prepared. The heat was vacuum induction melted.

TABLE I

| | wt. % |
|---|---|
| C | 0.010 |
| Mn | 0.28 |
| Si | 0.16 |
| P | 0.007 |
| S | 0.002 |
| Cr | 0.15 |
| Ni | 20.26 |
| Mo | 4.06 |
| Cu | 0.02 |
| Co | 0.01 |
| Al | 0.002 |
| Ti | <0.002 |
| V | <0.01 |
| Fe | Bal. |

Example 1

A first section of the heat was hot rolled to a first intermediate size of 2 in. wide by 0.13 in. thick. A first set of test coupons 0.62 in. by 1.4 in. were cut from the hot rolled strip, annealed at 850° C. for 30 minutes, and then quenched in brine. Several of the test coupons were then cold rolled to one of three additional intermediate thicknesses. The aim thicknesses for the additional intermediate thicknesses were 0.005 in., 0.010 in., and 0.031 in. The aim thicknesses were selected so that reductions of 50%, 75%, 92%, and 98% respectively would be sufficient to reduce the intermediate size coupons to the aim final thickness, 0.0025 in.

The intermediate-size coupons were then aged at various combinations of time and temperature. Aging was carried out in air with the coupons sealed in metal envelopes. The aged coupons were quenched in brine and then grit blasted. Aging times of 4 minutes, 1 hour, and 20 hours were selected for this first set of coupons. The aging temperatures ranged from 496° C. to 579° C. in increments of 8.33°.

DC magnetic properties along the rolling direction of each specimen were determined using a YEW hysteresigraph, an 8276 turn solenoid, and a 2000 turn $B_i$ coil. The maximum magnetizing field was 250 Oe. The actual data points were determined graphically from the hysteresis curves. The results of the magnetic testing on several of the first set of coupons are presented in Tables II–V including the amount of the final cold reduction (Rolling Reduction, Percent), the aging time (Aging Time), the aging temperature (Aging Temp.) in °C., the magnetic remanence ($B_r$) in gauss, and the longitudinal coercivity (Long. $H_c$) in oersteds (Oe).

TABLE II

| Rolling Reduction (Percent) | Aging Time | Aging Temp. (°C.) | $B_r$ (Gauss) | Long. $H_c$, (Oe) |
|---|---|---|---|---|
| 31.0 | 4 min. | 521 | 13,400 | 29 |
| 23.8 | 4 min. | 529 | 11,900 | 28 |
| 40.9 | 4 min. | 537 | 13,800 | 40 |
| 38.6 | 4 min. | 546 | 13,200 | 42 |
| 41.9 | 4 min. | 554 | 11,700 | 44 |
| 35.7 | 4 min. | 562 | 12,500 | 61 |
| 37.2 | 4 min. | 571 | 12,200 | 56 |
| 37.2 | 4 min. | 579 | 11,300 | 34 |
| 28.6 | 1 hr. | 512 | 12,900 | 53 |
| 32.6 | 1 hr. | 521 | 12,600 | 69 |
| 27.9 | 1 hr. | 529 | 10,900 | 81 |
| 40.9 | 1 hr. | 537 | 11,200 | 98 |
| 39.5 | 1 hr. | 546 | 11,300 | 93 |
| 37.2 | 1 hr. | 554 | 10,500 | 68 |
| 40.5 | 1 hr. | 562 | 12,700 | 54 |
| 34.9 | 20 hrs. | 496 | 11,700 | 54 |
| 34.1 | 20 hrs. | 504 | 10,600 | 72 |
| 33.3 | 20 hrs. | 512 | 10,300 | 87 |
| 38.1 | 20 hrs. | 521 | 10,400 | 96 |
| 38.1 | 20 hrs. | 529 | 9,100 | 103 |
| 47.7 | 20 hrs. | 537 | 10,700 | 102 |
| 45.5 | 20 hrs. | 546 | 11,300 | 76 |
| 39.5 | 20 hrs. | 554 | 10,400 | 57 |
| 45.5 | 20 hrs. | 562 | 11,500 | 28 |

TABLE III

| Rolling Reduction (Percent) | Aging Time | Aging Temp. (°C.) | $B_r$ (Gauss) | Long. $H_c$, (Oe) |
|---|---|---|---|---|
| 63.2 | 4 min. | 529 | 10,000 | 12 |
| 77.5 | 4 min. | 537 | 10,100 | 17 |
| 68.8 | 4 min. | 546 | 12,600 | 16 |
| 70.8 | 4 min. | 554 | 13,100 | 20 |
| 65.3 | 1 hr. | 512 | 13,400 | 29 |
| 67.0 | 1 hr. | 521 | 13,800 | 39 |
| 64.2 | 1 hr. | 529 | 11,800 | 47 |
| 65.6 | 1 hr. | 537 | 12,100 | 62 |
| 70.2 | 1 hr. | 546 | 13,200 | 59 |
| 69.9 | 1 hr. | 554 | 12,600 | 43 |
| 70.1 | 1 hr. | 562 | 13,300 | 19 |
| 62.4 | 20 hrs. | 496 | 12,400 | 41 |
| 62.4 | 20 hrs. | 504 | 11,500 | 54 |

TABLE III-continued

| Rolling Reduction (Percent) | Aging Time | Aging Temp. (°C.) | $B_r$ (Gauss) | Long. $H_c$, (Oe) |
|---|---|---|---|---|
| 67.0 | 20 hrs. | 512 | 12,000 | 64 |
| 68.4 | 20 hrs. | 521 | 12,200 | 70 |
| 69.1 | 20 hrs. | 529 | 11,300 | 85 |
| 67.7 | 20 hrs. | 537 | 11,500 | 78 |
| 72.3 | 20 hrs. | 546 | 13,300 | 53 |
| 71.0 | 20 hrs. | 554 | 12,600 | 30 |

TABLE IV

| Rolling Reduction (Percent) | Aging Time | Aging Temp. (°C.) | $B_r$ (Gauss) | Long. $H_c$, (Oe) |
|---|---|---|---|---|
| 91.0 | 4 min. | 529 | 10,000 | 13 |
| 92.2 | 4 min. | 537 | 10,500 | 15 |
| 91.6 | 4 min. | 546 | 10,900 | 14 |
| 91.2 | 4 min. | 554 | 9,400 | 13 |
| 90.2 | 1 hr. | 529 | 12,200 | 17 |
| 89.2 | 1 hr. | 537 | 12,900 | 23 |
| 90.6 | 1 hr. | 546 | 13,400 | 27 |
| 90.7 | 1 hr. | 554 | 11,900 | 20 |
| 88.3 | 20 hrs. | 512 | 13,200 | 36 |
| 88.2 | 20 hrs. | 521 | 13,200 | 43 |
| 90.5 | 20 hrs. | 529 | 12,700 | 42 |
| 88.6 | 20 hrs. | 537 | 12,600 | 36 |
| 91.1 | 20 hrs. | 546 | 13,800 | 30 |
| 91.0 | 20 hrs. | 554 | 12,900 | 16 |

TABLE V

| Rolling Reduction (Percent) | Aging Time | Aging Temp. (°C.) | $B_r$ (Gauss) | Long. $H_c$, (Oe) |
|---|---|---|---|---|
| 97.8 | 4 min. | 529 | 8,700 | 13 |
| 97.9 | 4 min. | 537 | 9,400 | 13 |
| 98.0 | 4 min. | 546 | 9,500 | 14 |
| 97.7 | 4 min. | 554 | 8,200 | 13 |
| 97.6 | 1 hr. | 529 | 11,000 | 13 |
| 97.6 | 1 hr. | 537 | 11,300 | 14 |
| 97.7 | 1 hr. | 546 | 11,300 | 13 |
| 97.6 | 1 hr. | 554 | 10,200 | 12 |
| 97.1 | 20 hrs. | 496 | 12,400 | 16 |
| 97.0 | 20 hrs. | 504 | 12,100 | 18 |
| 96.8 | 20 hrs. | 512 | 12,500 | 20 |
| 97.1 | 20 hrs. | 521 | 13,000 | 19 |
| 97.4 | 20 hrs. | 529 | 12,500 | 17 |
| 97.5 | 20 hrs. | 537 | 12,800 | 15 |
| 97.6 | 20 hrs. | 546 | 11,700 | 13 |
| 97.8 | 20 hrs. | 554 | 10,000 | 10 |

Not all combinations of time, temperature, and % cold reduction were tested because of the large number of specimens. Moreover, in practice, it proved difficult to fully cold roll the aged material with the available equipment. Consequently, the actual final reductions as shown in the tables are lower than expected and vary from specimen to specimen. Table II presents the results for test coupons having an aim final cold reduction of about 50%. Table III presents the results for test coupons having an aim final cold reduction of about 75%. Table IV presents the results for test coupons having an aim final cold reduction of about 92%. Table V presents the results for test coupons having an aim final cold reduction of about 98%.

The data in Tables II–V show that the process according to the present invention provides ferromagnetic articles that have desirable combinations of coercivity and magnetic remanence with fewer processing steps than the known processes. It is evident from the data in Table V that cold reductions in excess of about 90% did not provide a coercivity of at least 30 Oe under any of the aging conditions tested.

Example 2

A second section of the above-described heat was hot rolled to 0.134 in. thick strip. A second set of test coupons, 0.6 in. by 2 in. were cut from the hot rolled strip, pointed, and then cold rolled to various thicknesses ranging from 0.004 in. to 0.077 in. The aim thicknesses for the test coupons were selected so that reductions of 0% to 95% would be sufficient to reduce the intermediate size coupons to the aim final thickness, 0.004 in. The test coupons were then aged at various combinations of time and temperature. Aging was carried out in air with the coupons sealed in metal envelopes. Aging times of 4 minutes, 4 hours, and 20 hours were selected for this second set of coupons. The aging temperatures ranged from 480° C. to 618° C. The 4 minute ages were conducted in a box furnace and were followed by quenching in brine. The 4 hour and 20 hour ages were conducted in a convection furnace utilizing the following heating cycle.

| Time | Temperature |
|---|---|
| 0 hrs | $T_{soak}$ - 400° F. |
| 3 hrs | $T_{soak}$ - 130° F. |
| 4 hrs | $T_{soak}$ - 79° F. |
| 7 hrs | $T_{soak}$ - 16° F. |
| 9 hrs | $T_{soak}$ |
| 13 or 29 hrs | $T_{soak}$ |
| 15 or 31 hrs | $T_{soak}$ - 522° F. |

During heat-up, the temperature was ramped linearly and approximately one hour was required for the temperature to rise from room temperature to the 0-hour temperature. On cooling, the temperature returned to room temperature in approximately 1 hour after the end of the cycle.

DC magnetic properties in the rolling direction were determined in the same manner as for the first set of specimens, except that the maximum magnetizing field was 350 Oe. The results of the magnetic testing on the second set of coupons are presented in Tables. VI–VIII including the aging time (Age Time), the aging temperature (Age Temp.) in °C., the amount of the final cold reduction (Rolling Reduction, Percent), the longitudinal coercivity (Coercivity) in oersteds (Oe), and the magnetic remanence (Remanence) in gauss.

TABLE VI

| Age Time | Age Temp. (°C.) | Rolling Reduction (Percent) | Coercivity (Oersteds) | Remanence (Gauss) |
|---|---|---|---|---|
| 4 min. | 571 | 0* | 152 | 5800 |
| | | 5 | 146 | 7200 |
| | | 7 | 143 | 7600 |
| | | 18 | 116 | 9700 |
| | 582 | 0* | 147 | 4600 |
| | | 6 | 127 | 7400 |
| | | 8 | 123 | 7900 |
| | | 23 | 81 | 11000 |
| | 593 | 0* | 119 | 6000 |
| | | 5 | 91 | 9100 |
| | | 9 | 83 | 9800 |
| | | 23 | 56 | 12100 |

TABLE VI-continued

| Age Time | Age Temp. (°C.) | Rolling Reduction (Percent) | Coercivity (Oersteds) | Remanence (Gauss) |
|---|---|---|---|---|
| | 604 | 0* | 95 | 9100 |
| | | 7 | 62 | 11200 |
| | | 11 | 54 | 11800 |
| | | 24 | 34 | 12600 |
| | 616 | 0* | 72 | 11200 |
| | | 6 | 40 | 11900 |
| | | 10 | 37 | 12000 |
| | | 24 | 27 | 11900 |

TABLE VII

| Age Time | Age Temp. (°C.) | Rolling Reduction (Percent) | Coercivity (Oersteds) | Remanence (Gauss) |
|---|---|---|---|---|
| 4 hr. | 494 | 0* | 25 | 14100 |
| | | 4 | 39 | 13100 |
| | | 10 | 32 | 13200 |
| | | 18 | 34 | 13300 |
| | | 50 | 27 | 13500 |
| | | 65 | 21 | 14200 |
| | | 70 | 18 | 14500 |
| | | 74 | 17 | 13800 |
| | 504 | 0* | 33 | 13600 |
| | | 5 | 48 | 12500 |
| | | 10 | 46 | 12700 |
| | | 19 | 42 | 13100 |
| | | 49 | 37 | 13500 |
| | | 65 | 27 | 14100 |
| | | 70 | 24 | 14000 |
| | | 75 | 22 | 13800 |
| | 514 | 0* | 49 | 13000 |
| | | 5 | 63 | 12100 |
| | | 9 | 61 | 12400 |
| | | 19 | 58 | 12800 |
| | | 52 | 49 | 13500 |
| | | 65 | 38 | 13900 |
| | | 70 | 33 | 14000 |
| | | 74 | 30 | 14100 |
| | 524 | 0* | 65 | 11800 |
| | | 5 | 79 | 11300 |
| | | 10 | 76 | 11400 |
| | | 20 | 73 | 11800 |
| | | 52 | 62 | 12700 |
| | | 66 | 50 | 13400 |
| | | 70 | 46 | 13300 |
| | | 75 | 39 | 13700 |
| | 534 | 0* | 82 | 10500 |
| | | 5 | 94 | 10400 |
| | | 7 | 90 | 10600 |
| | | 22 | 86 | 11200 |
| | | 49 | 73 | 12200 |
| | | 65 | 60 | 13000 |
| | | 71 | 53 | 13100 |
| | | 76 | 44 | 13500 |
| | 544 | 0* | 94 | 9600 |
| | | 5 | 101 | 9600 |
| | | 10 | 100 | 9900 |
| | | 25 | 93 | 10600 |
| | | 52 | 77 | 12000 |
| | | 64 | 64 | 12700 |
| | | 71 | 55 | 13100 |
| | | 74 | 49 | 13300 |
| | 553 | 0* | 102 | 8700 |
| | | 5 | 110 | 8800 |
| | | 8 | 109 | 8900 |
| | | 17 | 100 | 9900 |
| | | 51 | 79 | 11900 |
| | | 65 | 59 | 13000 |
| | | 70 | 53 | 13200 |
| | | 74 | 46 | 13600 |
| | 563 | 0* | 109 | 7500 |

TABLE VII-continued

| Age Time | Age Temp. (°C.) | Rolling Reduction (Percent) | Coercivity (Oersteds) | Remanence (Gauss) |
|---|---|---|---|---|
| | | 8 | 115 | 8100 |
| | | 10 | 116 | 8000 |
| | | 21 | 105 | 9000 |
| | | 51 | 78 | 12000 |
| | | 65 | 55 | 13100 |
| | | 69 | 49 | 13500 |
| | | 75 | 43 | 13700 |
| | 573 | 0* | 114 | 6400 |
| | | 6 | 118 | 7100 |
| | | 12 | 117 | 7300 |
| | | 21 | 105 | 8700 |
| | | 49 | 62 | 12700 |
| | | 65 | 44 | 13800 |
| | | 70 | 43 | 13900 |
| | | 74 | 36 | 14000 |
| | 581 | 0* | 114 | 5000 |
| | | 5 | 113 | 6000 |
| | | 8 | 114 | 6400 |
| | | 19 | 103 | 8400 |
| | | 51 | 61 | 12700 |
| | | 65 | 45 | 13300 |
| | | 69 | 36 | 13700 |
| | | 74 | 32 | 13900 |
| | 588 | 0* | 111 | 3900 |
| | | 3 | 106 | 5900 |
| | | 8 | 105 | 6900 |
| | | 20 | 92 | 9100 |
| | | 52 | 46 | 13200 |
| | | 66 | 36 | 13700 |
| | | 70 | 29 | 13900 |
| | | 75 | 26 | 14100 |
| | 598 | 0* | 100 | 2500 |
| | | 8 | 88 | 8100 |
| | | 9 | 86 | 8200 |
| | | 23 | 65 | 11000 |
| | | 49 | 39 | 12800 |
| | | 64 | 30 | 13600 |
| | | 71 | 24 | 14000 |
| | | 76 | 23 | 14000 |
| | 608 | 0* | 77 | 6900 |
| | | 6 | 60 | 9900 |
| | | 10 | 52 | 10800 |
| | | 24 | 40 | 12000 |
| | | 53 | 30 | 13200 |
| | | 66 | 26 | 13200 |
| | | 69 | 23 | 13400 |
| | | 75 | 22 | 13500 |
| | 618 | 0* | 64 | 10000 |
| | | 10 | 42 | 11200 |
| | | 13 | 41 | 11300 |
| | | 25 | 35 | 11800 |
| | | 52 | 27 | 12700 |
| | | 64 | 24 | 12600 |
| | | 71 | 22 | 12800 |
| | | 75 | 21 | 13100 |

TABLE VIII

| Age Time | Age Temp. (°C.) | Rolling Reduction (Percent) | Coercivity (Oersteds) | Remanence (Gauss) |
|---|---|---|---|---|
| 20 hr. | 480 | 4 | 35 | 13100 |
| | | 10 | 34 | 13100 |
| | | 23 | 30 | 13600 |
| | 491 | 3 | 42 | 12500 |
| | | 10 | 40 | 12600 |
| | | 21 | 39 | 13000 |
| | 500 | 6 | 52 | 12100 |
| | | 7 | 51 | 11900 |
| | | 19 | 49 | 12700 |
| | 520 | 0* | 70 | 10900 |

TABLE VIII-continued

| Age Time | Age Temp. (°C.) | Rolling Reduction (Percent) | Coercivity (Oersteds) | Remanence (Gauss) |
|---|---|---|---|---|
| | | 6 | 79 | 10600 |
| | | 12 | 78 | 10800 |
| | | 21 | 77 | 11100 |
| | | 50 | 68 | 11900 |
| | | 66 | 57 | 12500 |
| | | 75 | 47 | 12800 |
| | | 85 | 34 | 13000 |
| | | 95 | 20 | 13300 |
| | 530 | 0* | 84 | 9700 |
| | | 4 | 92 | 9600 |
| | | 11 | 90 | 10000 |
| | | 20 | 88 | 10300 |
| | | 49 | 77 | 11400 |
| | | 65 | 64 | 12100 |
| | | 75 | 52 | 12600 |
| | | 84 | 39 | 13100 |
| | | 95 | 22 | 13200 |
| | 540 | 0* | 94 | 8600 |
| | | 5 | 101 | 8600 |
| | | 12 | 100 | 9000 |
| | | 22 | 96 | 9700 |
| | | 50 | 79 | 11300 |
| | | 65 | 64 | 12300 |
| | | 75 | 51 | 12800 |
| | | 85 | 36 | 13300 |
| | | 95 | 20 | 13600 |

The data in Tables VI–VIII show that the process according to the present invention provides ferromagnetic articles that have desirable combinations of coercivity and magnetic remanence with substantially fewer processing steps than the known processes. Examples marked with an asterisk (*) in Tables VI–VIII, had no final cold reduction, and therefore are considered to be outside the scope of the present invention.

The terms and expressions which have been employed herein are used as terms of description, not of limitation. There is no intention in the use of such terms and expressions of excluding any equivalents of the features shown and described or portions thereof. However, it is recognized that various modifications are possible within the scope of the invention claimed.

What is claimed is:

1. A method of preparing a duplex ferromagnetic alloy article, consisting essentially of the following steps:

providing an elongated form of a ferromagnetic alloy having a substantially fully martensitic microstructure and a cross-sectional area;

heating said elongated form at a temperature in the range of about 475°–625° C. for a time of at least about 4 minutes, said temperature and time being selected to cause precipitation of austenite in the martensitic microstructure of the alloy; and then cold working said elongated form along a magnetic axis thereof to reduce the cross-sectional area of said elongated form by an amount sufficient to provide a magnetic coercivity, $H_c$, of at least about 30 Oe along said magnetic axis.

2. The method of claim 1 wherein said alloy contains about 16–30 wt. % Ni, about 3–10 wt. % Mo, and the balance essentially Fe.

3. The method of claim 1 wherein said elongated form of the ferromagnetic alloy is selected from the group consisting of wire and strip.

4. The method of claim 1 wherein the step of heating the elongated form of the ferromagnetic alloy is performed for up to about 20 hours.

5. The method of claim 4 wherein the step of heating the elongated form of the ferromagnetic alloy is performed for up to about 4 hours.

6. The method of claim 1 wherein the step of heating the elongated form of ferromagnetic alloy is performed at a temperature of about 485°–620° C.

7. The method of claim 6 wherein the step of heating the elongated form of ferromagnetic alloy is performed at a temperature of about 530°–575° C.

8. The method of claim 1 wherein the cross-sectional area of the elongated form is reduced up to about 90%.

9. The method of claim 8 wherein the cross-sectional area of the elongated form is reduced by at least about 5%.

10. The method of claim 1 wherein the elongated form is cold worked along its longitudinal axis.

11. A method of preparing a duplex ferromagnetic alloy article, consisting essentially of the following steps:

providing an elongated form of a ferromagnetic alloy having a substantially fully martensitic microstructure and a cross-sectional area;

heating said elongated form at a temperature in the range of about 475°–625° C. for a time of at least about 4 minutes to about 20 hours, said temperature and time being selected to cause precipitation of austenite in the martensitic microstructure of the alloy; and then cold working said elongated form along a magnetic axis thereof to reduce the cross-sectional area of said elongated form by an amount sufficient to provide a magnetic coercivity, $H_c$, of at least about 30 Oe and a magnetic remanence, $B_r$ of not less than about 10,500 Gauss along said magnetic axis.

12. The method of claim 11 wherein the step of heating the elongated form of ferromagnetic alloy is performed at a temperature of about 485°–620° C.

13. The method of claim 12 wherein the step of heating the elongated form of ferromagnetic alloy is performed at a temperature of about 530°–575° C.

* * * * *